United States Patent [19]

Scarpini

[11] Patent Number: 4,458,391

[45] Date of Patent: Jul. 10, 1984

[54] SLIDE-FASTENER HALF AND METHOD OF MAKING SAME

[75] Inventor: Manuela Scarpini, Milan, Italy

[73] Assignee: Interbrev S.A., Luxembourg, Luxembourg

[21] Appl. No.: 247,642

[22] Filed: Mar. 26, 1981

[30] Foreign Application Priority Data

Apr. 1, 1980 [CH] Switzerland ..... 2546/80

[51] Int. Cl.[3] ..... A44B 19/00

[52] U.S. Cl. ..... 24/403; 264/252

[58] Field of Search ..... 139/384; 24/205.16 R, 24/205.13 D; 264/252

[56] References Cited

U.S. PATENT DOCUMENTS

| | | | |
|---|---|---|---|
| 2,731,671 | 1/1956 | Zimmerman | 264/252 X |
| 3,885,273 | 5/1975 | Heimberger | 24/205.13 D |
| 3,890,679 | 6/1975 | Simon | 264/252 X |
| 3,964,137 | 6/1976 | Kihara | 24/205.13 D |
| 4,033,014 | 7/1977 | Manning | 24/205.13 D |
| 4,290,175 | 9/1981 | Moertel | 24/205.13 D |
| 4,426,066 | 1/1984 | MacFee | 264/252 X |

FOREIGN PATENT DOCUMENTS

| | | | |
|---|---|---|---|
| 1152073 | 8/1963 | Fed. Rep. of Germany | 24/205.13 D |
| 2741579 | 3/1978 | Fed. Rep. of Germany | 24/205.13 D |

*Primary Examiner*—Gene Mancene
*Assistant Examiner*—Wenceslao J. Contreras
*Attorney, Agent, or Firm*—Karl F. Ross; Herbert Dubno

[57] ABSTRACT

A woven stringer tape of a slide-fastener half, designed to support a row of thermoplastic coupling elements molded around a carrier cord adjoining a longitudinal edge of the tape, has warp threads parallel to that edge traversed by a weft thread looped about the cord, at least two of these warp threads close to the core and in mutual phase opposition consisting of thermoplastic monofilaments with a melting point lower than that of the coupling elements. Upon the molding of the latter, these two thermoplastic warp threads are partially melted along surface portions in contact with the coupling elements so as to form notches in which the coupling elements positively engage for a firm anchorage to the fabric.

8 Claims, 4 Drawing Figures

SLIDE-FASTENER HALF AND METHOD OF MAKING SAME

FIELD OF THE INVENTION

My present invention relates to a slide-fastener half of the type comprising a woven stringer tape supporting a set of spaced-apart coupling elements of thermoplastic material molded around a longitudinal edge of the tape, as well as to a method of making same.

BACKGROUND OF THE INVENTION

Such a stringer tape is conventionally woven from a multiplicity of warp threads and passes of a single weft thread which is also looped around a carrier cord adjoining the aforementioned longitudinal edge; the coupling elements are then molded around the cord as well as around several adjoining warp threads paralleling same. A problem encountered in the manufacture of slide-fastener halves of this type is to ensure a firm adhesion of the thermoplastic coupling elements to the fabric. If the warp threads of the fabric consist of natural fibers such as cotton or viscose, the thermoplastic material will readily permeate their interstrices, yet subsequent washings will cause these fibers to swell and thus to loosen the bond between them and the coupling elements. Synthetic warp threads are usually made of material such as polyester, having a melting point higher than that of the coupling elements, in order to prevent an excessive weakening of the tape in the molding operation. In such a case, however, the bond between the warp threads and the coupling elements is relatively poor so that these elements are not firmly seated along the fabric edge and may shift on being subjected to the traction of a slider interlinking the two halves of the fastener.

OBJECT OF THE INVENTION

An important object of my present invention, therefore, is to provide an improved slide-fastener half of the general character referred to in which these drawbacks are avoided.

A related object is to provide a method of making such a fastener half in a manner insuring firm adhesion of the coupling elements to the tape while preserving the tensile strength of the latter.

SUMMARY OF THE INVENTION

I realize these objects, in accordance with my present invention, by making at least two warp threads adjoining the carrier cord from thermoplastic monofilaments having a melting point lower that that of the coupling elements, these warp threads being relatively phase-shifted with reference to the weft thread so that at least some passes of the latter overlie one and underlie the other monofilament.

When the coupling heads are molded around the carrier cord and the adjoining warp threads including the two or more monofilaments, surface portions of the latter in contact with the coupling elements are melted so as to form notches or indentations penetrated by the coupling elements which are thus firmly interlocked with and fused to the monofilaments upon subsequent hardening.

When the remaining warp threads of the stringer tape consist of natural fibers, or of synthetic fibers (e.g. polyester) with a melting point higher than that of the coupling elements, they will remain unaffected by the molding operation so that the strength of the fabric is not significantly lowered. Advantageously, the monofilaments of lower melting point are made of larger diameter than the other warp threads so that the diameters of the indented portions thereof are approximately equal to those of the other warp threads.

When the coupling elements and the monofilaments consist of polymers with similar molecular structure, such as different polyamides, they will firmly bond to each other aside from their mechanical interlocking. Thus, I may choose a polyamide commercially known as Nylon 66 (melting point of 249° C.) for the coupling elements and a polyamide known as Nylon 6 (melting point between 213° and 221° C.), or possibly a copolymer of Nylon 6 and Nylon 9, for the monofilaments.

BRIEF DESCRIPTION OF THE DRAWING

My invention will now be described in detail with reference to the accompanying drawing in which.

SPECIFIC DESCRIPTION

Figure 2:
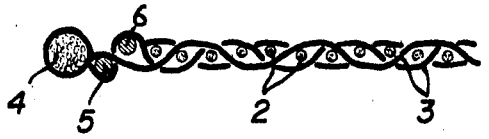
FIG. 2 is a cross-sectional view taken on the line II—II of FIG. 1.
Figure 1:
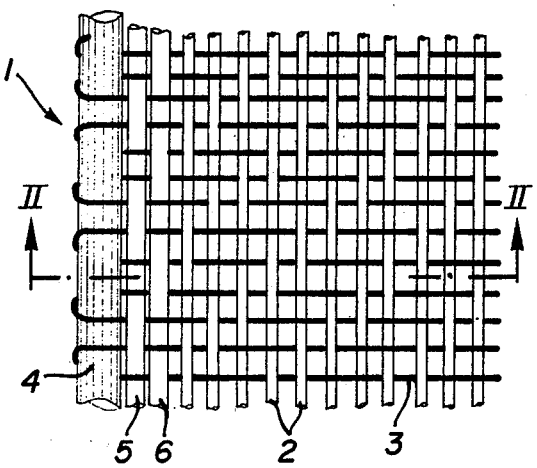
FIG. 1 is a plan view of a representative portion of a stringer tape and a carrier cord for a slide-fastener half embodying my invention.

In FIGS. 1 and 2 I have shown part of a stringer tape 1 woven from warp threads 2 and a weft thread 3 traversing the warp threads in a multiplicity of passes, this weft thread being also looped about a carrier cord 4 of fibrous material in a manner well known in the art. Immediately adjoining the cord 4 are two special warp threads 5 and 6, consisting of thermoplastic monofilaments, interwoven in mutual phase opposition with the passes of weft thread 3. As shown, monofilaments 5 and 6 are of substantially larger diameter than the remaining warp threads 2.

Figure 3:
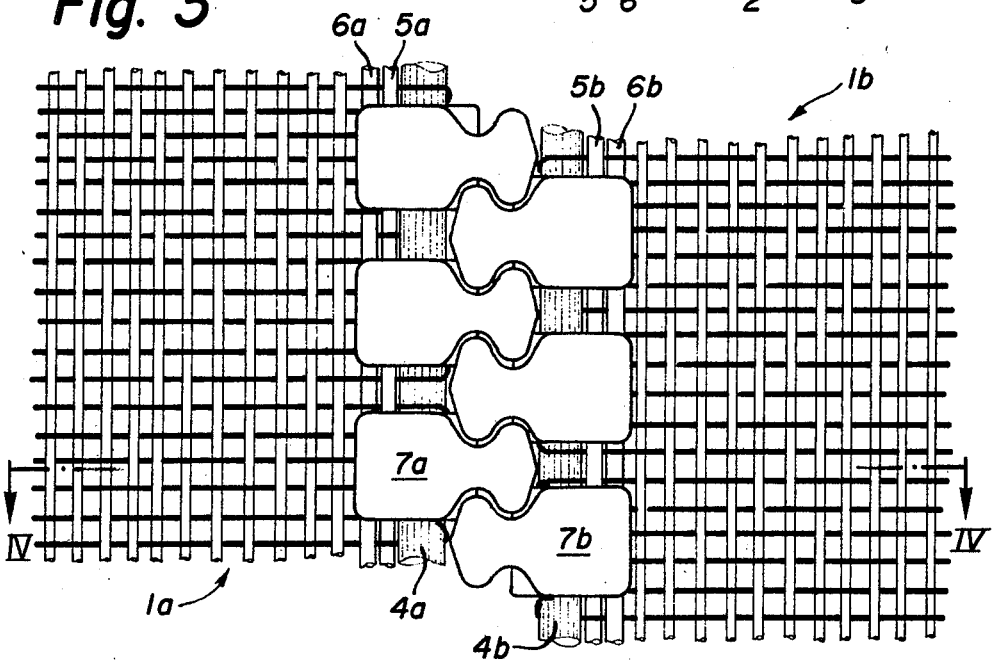
FIG. 3 shows two slide-fastener halves with interlinked coupling elements molded onto stringer tapes and carrier cords as shown in FIGS. 1 and 2.
Figure 4:
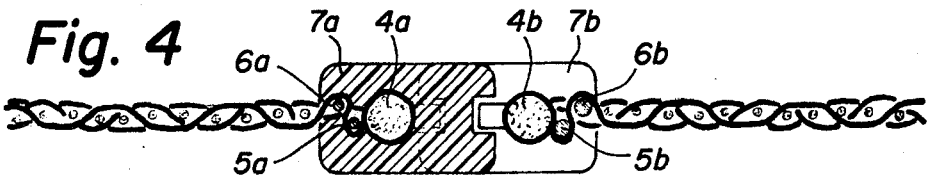
FIG. 4 is a cross-sectional view taken on the line IV—IV of FIG. 3.

FIGS. 3 and 4 illustrate part of an entire slide fastener whose halves comprise stringer tapes **1*a* and 1*b* along with carrier cords 4*a* and 4*b* identical with the tape 1 and the cord 4 of FIGS. 1 and 2. Each slide-fastener half further comprises a multiplicity of coupling elements 7*a* or 7*b* of thermoplastic material molded in spaced-apart relationship around the respective carrier cord 4*a* or 4*b* and the adjoining monofilamentary warp threads 5*a*, 6*a* or 5*b*, 6*b*. From FIG. 4, which shows a section of a coupling element 7*a*, it will be apparent that the diameters of filaments 5*a* and 6*a* are reduced in the region of these coupling elements compared with the original diameter which the filaments retain between adjacent coupling elements as illustrated for threads 5*b* and 6*b***. This reduction, as explained above, is due to a partial melting of the monofilaments when the coupling elements are molded therearound. The temperature and time of the molding operation should, of course, be so chosen that the melting of the monofilaments is confined to their surface zones in direct contact with the coupling elements.

The two (or possibly more) monofilamentary warp threads 5, 6 to be embraced by the coupling elements need not be immediately adjacent and could be separated from each other and/or from the cord 4 by additional warp threads 2 of nonmelting or higher-melting filamentary material. The weft thread 3 obviously also consists of a material which does not melt during the molding process.

I claim:

1. A slide-fastener half comprising:

a stringer tape woven from a multiplicity of warp threads and a weft thread looped around a carrier cord extending along an edge of said tape parallel to said warp threads; and a row of spaced-apart coupling elements of thermoplastic material each molded individually around said carrier cord and a plurality of adjoining warp threads as well as around part of said weft thread, at least two of said adjoining warp threads relatively phase-shifted with reference to said weft thread being thermoplastic monofilaments with a melting point lower than that of said coupling elements, said monofilaments having indented surface portions interlockingly engaged by and fused to said coupling elements.

2. A slide-fastener half as defined in claim 1 wherein said monofilaments have a diameter exceeding that of the remaining warp threads.

3. A slide-fastener half as defined in claim 2 wherein said remaining warp threads consist of nonmelting filamentary material.

4. A slide-fastener half as defined in claim 2 wherein said remaining warp threads consist of a material with a melting point higher than that of said coupling elements.

5. A slide-fastener half as defined in claim 1, or 2, 3 or 4 wherein said coupling elements and said monofilaments respectively consist of a higher-melting and a lower-melting polyamide.

6. A slide fastener with two halves as defined in claim 1, 2, 3 or 4.

7. A method of making a slide-fastener half, comprising the steps of:

weaving a stringer tape from a multiplicity of warp threads and a weft thread while looping said weft thread around a carrier cord placed alongside an edge of said tape paralleling said warp threads, at least two warp threads close to said edge and relatively phase-shifted with reference to said weft thread being made of monofilaments of thermoplastic material; and individually molding a multiplicity of spaced-apart coupling elements of thermoplastic material, with a melting point higher than that of said monofilaments, about said cord, part of said weft thread and adjoining warp threads including said monofilaments at a temperature and for a time sufficient to melt surface portions of said monofilaments in contact with said coupling elements whereby said surface portions are indented to form notches interlockingly engaged by and fused to said coupling elements upon subsequent cooling.

8. A method as defined in claim 7 wherein said monofilaments are made of a lower-melting polyamide and said coupling elements are molded from a higher-melting polyamide.

* * * * *